US006459202B1

(12) United States Patent
Kira et al.

(10) Patent No.: US 6,459,202 B1
(45) Date of Patent: Oct. 1, 2002

(54) DISCHARGE LAMP WITH ELECTRODE FITTING STRUCTURE

(75) Inventors: Takehiro Kira, Kobe; Shigehisa Hagi, Takasago, both of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 181 days.

(21) Appl. No.: 09/610,569

(22) Filed: Jul. 5, 2000

(30) Foreign Application Priority Data

Jul. 5, 1999 (JP) ..... 11-190189

(51) Int. Cl.[7] ..... H01J 17/04; H01J 61/04
(52) U.S. Cl. ..... 313/631; 313/491; 313/632
(58) Field of Search ..... 313/491, 631, 313/632

(56) References Cited

U.S. PATENT DOCUMENTS 3,902,090 A * 8/1975 Ekkelboom et al. ..... 313/217
5,451,837 A * 9/1995 Stevens et al. ..... 313/628

* cited by examiner

*Primary Examiner*—Michael H. Day
*Assistant Examiner*—Glenn Zimmerman
(74) *Attorney, Agent, or Firm*—Nixon Peabody LLP; David S. Safran

(57) ABSTRACT

To provide a discharge lamp in which, by a simple procedure, the tip of the electrode support bar can be fitted easily into a concavity formed in the base of the electrode, and can be stably fixed to the electrode with high holding power, the discharge lamp has an electrode (13) supported by an electrode support bar (15) via the tip **(15*a*) of the electrode support bar (15) engaging in a concavity (13*a*) formed in the base of the electrode, the tip of the electrode support bar (15) being provided with a slit (S) into which a spreader piece (20) is pressed to spread the slit (S). It is preferable that the electrode support bar (15)** be made of molybdenum.

6 Claims, 6 Drawing Sheets

DISCHARGE LAMP WITH ELECTRODE FITTING STRUCTURE

BACKGROUND OF THE INVENTION

1. Field of the Invention

This invention concerns discharge lamps, and in particular, the manner in which each of the electrodes is connected to the tip of an electrode support bar within a bulb of the lamp.

2. Description of Related Art

Conventionally, a discharge lamp has a bulb that comprises a light-emitting tube, which forms the light emitting space, and seal tubes connected to it on opposite sides. Sealed within the light-emitting tube of the bulb is a pair of facing electrodes (anode and cathode) made of tungsten, xenon gas, for example, and mercury. Each of the electrodes is fixed to the tip of a supporting electrode support bar that is made of tungsten and extends along the tube axis from the seal tube of the bulb into the light-emitting tube.

A well-known means of fixing the electrode to the tip of the electrode support bar, is to form a concavity in the base surface of the electrode, and fit the tip of the electrode support rod into the cavity with a buffer material between them. To explain more concretely, FIG. 7(*a*) shows a tapered concavity 50*a* formed in the base surface 50*b* of the electrode 50, such that the diameter of the concavity grows smaller from the base toward the tip of the electrode 50. The tip 51*a* of the support bar 51 is also tapered, such that its diameter grows smaller moving toward the tip of the bar, to match the shape of the concavity 50*a* of the electrode 50. The buffer material 52 is formed around the tip 51*a* of the electrode support bar 51. Next, as shown in FIG. 7(*b*), the tip 51*a* of the electrode support bar 51 is inserted into the concavity 50*a* of the electrode 50 and, as shown in FIG. 7(*c*), by pressing the tip 51*a* of the electrode support bar 51 so that the entire tip is accommodated within the concavity 50*a* of the electrode 50, the tip 51*a* of the electrode support bar 51 is fitted into the concavity 50*a* of the electrode 50, and is fixed to it.

Nevertheless, there are the following problems with such a technique.

(1) The buffer material 52 is formed by wrapping molybdenum foil or a tantalum sheet around the tip 51*a* of the electrode support bar 51, but adjustment of the thickness of the buffer material 52, i.e., adjustment of the thickness of the molybdenum foil or tantalum sheet used or of the number of turns wrapped, is determined by the fabricator through repeated trial and error, and so this operation is quite complex and requires relatively advanced technology. Moreover, after the tip 51*a* of the electrode support bar 51 is fitted into the concavity 50*a* of the electrode 50, a procedure is required to trim away any excess buffer material 52 that is exposed outside the concavity 50*a* of the electrode 50. In addition, both the concavity 50*a* of the electrode 50 and the tip 51*a* of the electrode support bar 51 are tapered to facilitate the insertion of the tip 51*a* of the electrode support bar 51 into the concavity 50*a* of the electrode 50, and the machining process to form the tapered concavity 50*a* in the electrode 50 and that to form the tapered tip 51*a* of the electrode support bar 51 require a high degree of machining precision. For those reasons, this means of fitting and fixing the tip 51*a* of the electrode support bar 51 into the concavity 50*a* of the electrode 50 takes time and effort, and so a high level of productivity is not possible.

(2) The holding power of the electrode support bar 51 on the electrode 50 (the force necessary to remove the tip 51*a* of the electrode support bar 51 from the concavity 50*a* of the electrode 50) depends on the thickness of the buffer material 52. Moreover, adjustment of the thickness of the buffer material 52 is done by repeated trial and error by the fabricator, as stated above, and so it is difficult to fix the electrode 50 to the tip 51*a* of the electrode support bar 51 with a holding power that is consistent from one product to the next. As a result, there is great fluctuation in the holding power of the electrode support bar 51 on the electrode 50 from one product to the next, and if the electrode support bar 51 has too little holding power on the electrode 50, the electrode 50 could fall off the electrode support bar 51 during shipping of the discharge lamp, or when the lamp is lighted.

SUMMARY OF THE INVENTION

In view the situation described above, it is a primary object of this invention to provide a discharge lamp in which, by a simple procedure, the tip of the electrode support bar can be fitted easily into a concavity formed in the base of the electrode, and can be stably fixed to the electrode with high holding power.

The discharge lamp of this invention is a discharge lamp having an electrode supported by an electrode support bar, preferably one made of molybdenum, by means of the tip of the electrode support bar engaging in a concavity formed in the electrode, in which the tip of the electrode support bar is made with a slit into which a spreader piece is pressed to spread the slit.

More specifically, in accordance with the invention, a spreader piece is mounted in a slit formed in the tip of the electrode support bar, and when the tip of the electrode support bar is pushed into the concavity in the electrode in that state, the spreader piece is pushed, by the bottom of the concavity in the electrode, into the slit in the electrode support bar. As a result, the slit is spread and the outer surface of the electrode support bar puts pressure on the inner surface of the concavity in the electrode, by which means the electrode is fixed to the tip of the electrode support bar. Thus, there is no need to use buffer material, and there is no need to taper the concavity in the electrode or the tip of the electrode support bar, and so the tip of the electrode support bar can be fitted easily to the concavity in the electrode by a simple process. Moreover, because a slit in the tip of the electrode support bar is spread and the outer surface of the electrode support bar is pressed against the inner surface of the electrode, the electrode is fixed to the tip of the electrode support bar stably and with great holding power. In addition, by forming the electrode support bar of molybdenum, which has high plasticity and toughness, it is possible to prevent damage to the tip of the electrode support bar when the slit is spread.

DETAILED DESCRIPTION OF THE INVENTION

The mode of implementation of the discharge lamp of this invention is explained in detail below.

Figure 1:
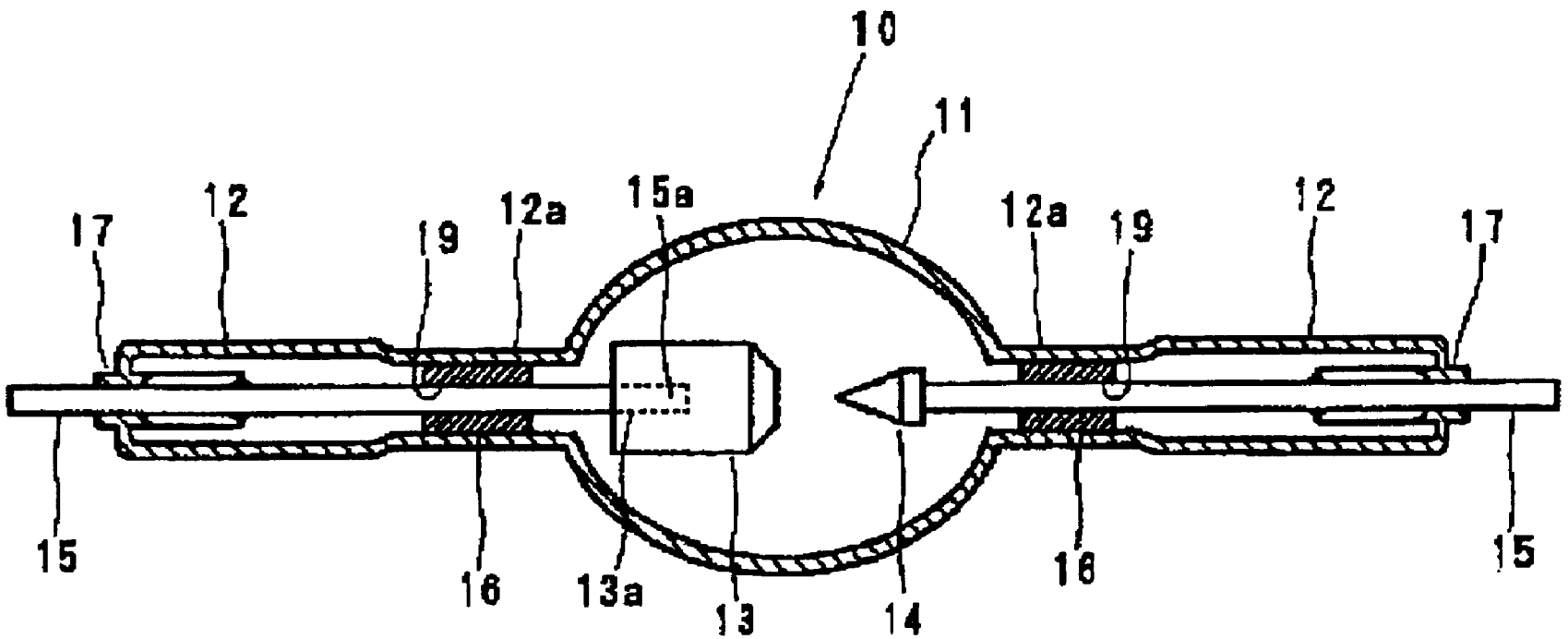
FIG. 1 is a cross-sectional view showing an example of a short arc discharge lamp in accordance with this invention.

FIG. 1 is an explanatory section showing an example of a short arc discharge lamp of this invention. The bulb 10 of this discharge lamp is made of quartz glass, and comprises a spherical light-emitting tube 11 and cylindrical seal tubes 12 connected to the light-emitting tube 11 extending outward on opposite sides. There is a constriction 12 where a portion of the seal tube 12 is reduced in diameter, near to the point where the seal tube 12 is joined to the light-emitting tube 11.

Figure 2:
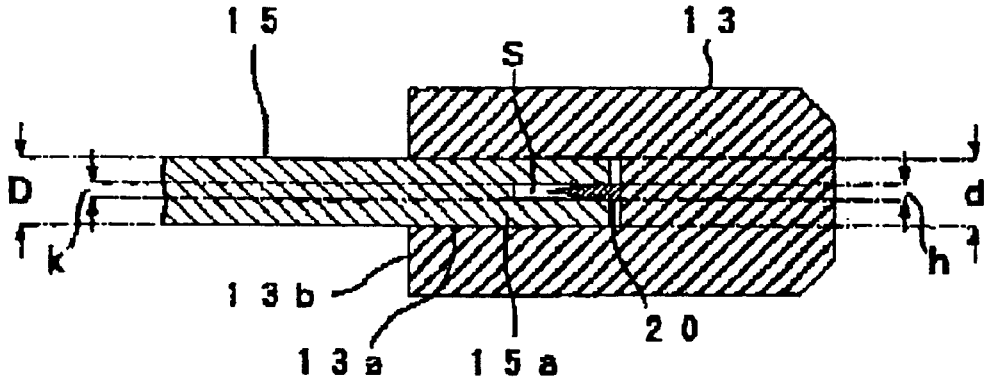
FIG. 2 is a cross-sectional view showing details of the anode and the tip of the electrode support bar of the discharge lamp in FIG. 1.
Figure 3:
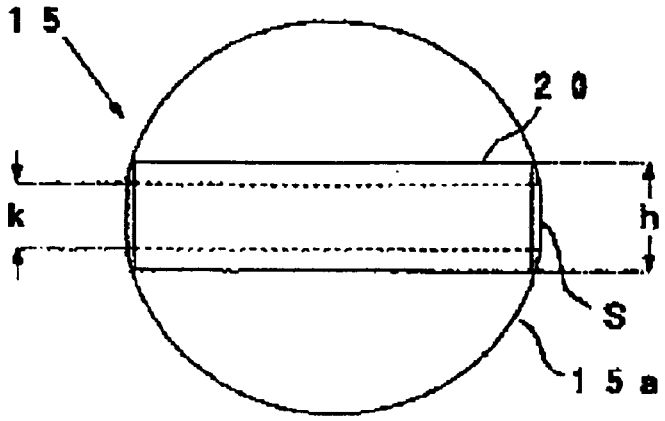
FIG. 3 is a plan view showing the electrode support bar of the discharge lamp in FIG. 1, as viewed from the tip.
Figure 4:
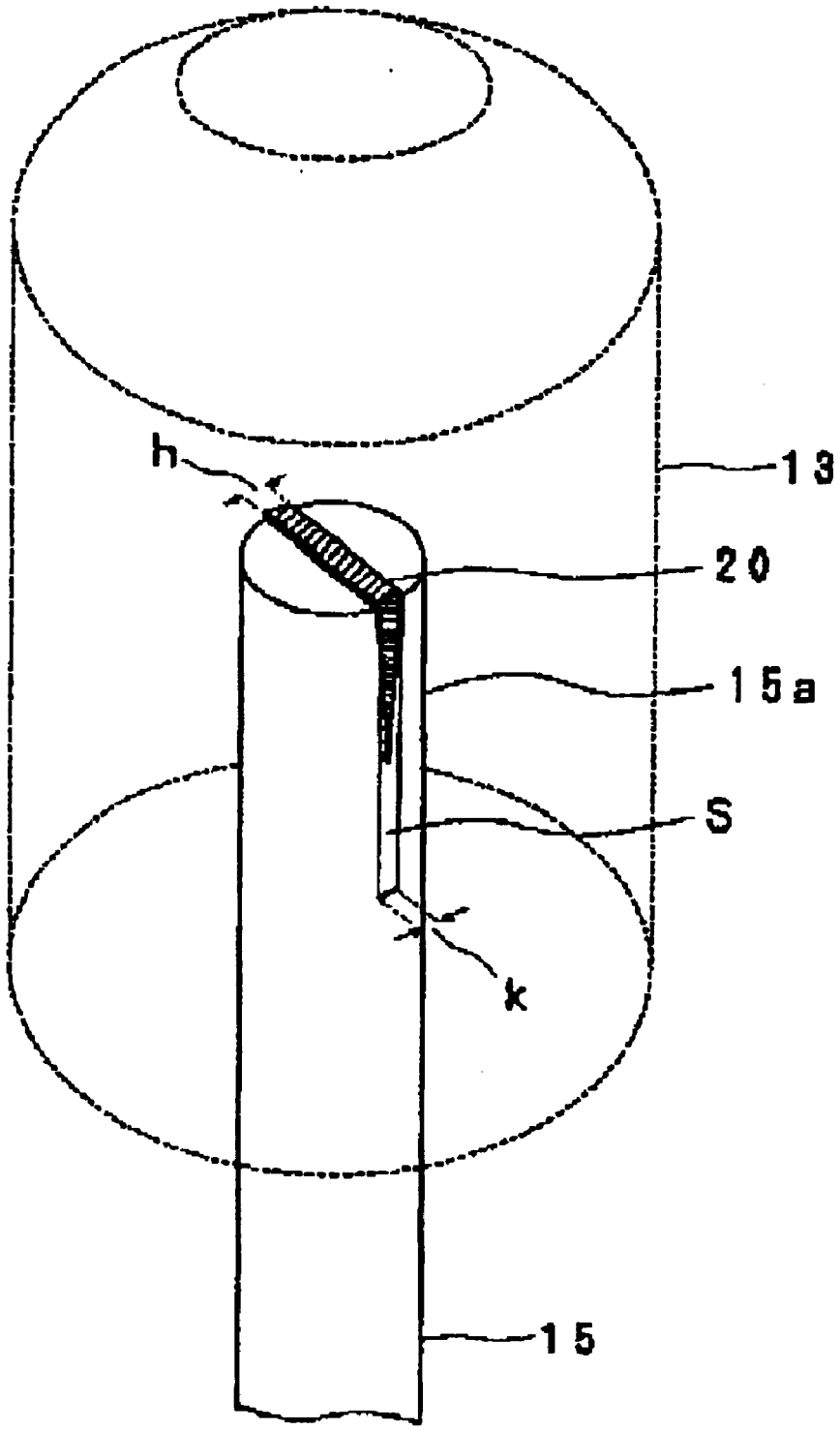
FIG. 4 is an oblique perspective view showing the tip of the electrode support bar of the discharge lamp in FIG. 1, as viewed through the anode.

Anode 13 and cathode 14 electrodes are located facing each other within the light-emitting tube 11 of the bulb 10; each of the electrodes 13, 14 is fixed to the tip of a cylindrical electrode support bar 15 made of molybdenum and is supported by the electrode support bar 15. To explain in greater detail, as shown in FIG. 2, there is a concavity 13*a* in the base surface 13*b* of the anode 13; the concavity 13*a* is cylindrical and has a diameter slightly larger than the diameter of the electrode support bar 15. The tip 15*a* of the electrode support bar 15 fits into this anode 13. And so, as shown in FIGS. 3 and 4, there is a slit S cut diametrically into the end of the tip 15*a* of the electrode support bar 15. A wedge-shaped spreader piece 20 (shown by shading in FIG. 4) is inserted into the slit S, and because the spreader piece 20 spreads the slit S and presses the outer surface of the electrode support bar 15 against the inner surface of the concavity 13*a* of the anode 13, the anode 13 is fixed to the tip 15*a* of the electrode support bar 15. The cathode 14 is fixed to the tip of an electrode support bar 15 in the same way as the anode 13.

In the above, the interior diameter d of the concavity 13*a* of the anode 13 (or cathode) is preferably 0.1 to 0.5 mm greater than the exterior diameter D of the tip 15*a* of the electrode support bar 15. If the interior diameter d of the concavity 13*a* of the anode 13 is too large, it becomes difficult to stably fix the anode 13 to the tip 15*a* of the electrode support bar 15 with great holding power.

The width k of the slit S of the electrode support bar 15 is preferable 3 to 10% of the exterior diameter D of the tip 15*a* of the electrode support bar 15. If the width k of the slit S is too small, it will be difficult to spread it with the spreader piece 20. On the other hand, if the width k of the slit S is too large, the tip 15*a* of the electrode support bar 15 is liable to be damaged when the spreader piece 20 is inserted into the slit S.

Also, the maximum thickness h of the spreader piece 20 (thickness of the back end) is preferably 1.5 to 2.5 times the width k of the slit S of the electrode support bar 15. If the maximum thickness h of the spreader piece 20 (thickness of the back end) is too small, the spreader piece 20 will be unable to spread the slit S enough, and it will be difficult to fix the anode 13 stably to the tip 15*a* of the electrode support bar 15 with great holding power. On the other hand, if the maximum thickness h of the spreader piece 20 (thickness of the back end) is too great, the tip 15*a* of the electrode support bar 15 is liable to be damaged when the spreader piece 20 is inserted into the slit S.

The electrode support bar 15 extends along the tube axis of the seal tube 12, and its end protrudes beyond the seal tube 12. In the outer end of the seal tube 12, the seal tube 12 and the electrode support bar 15 are bonded and form an air-tight seal 17. In the seal tube 12, a sleeve 16 that is made of quartz glass and that has a through hole 19 that fits the exterior diameter D of the electrode support bar 15 is penetrated by the electrode support bar 15. This sleeve 16 is supported by the constriction 12*a*, which is a part of the seal tube 12.

Sealed into the light-emitting tube 11 of the bulb 10 is a filler gas made of an inert gas like xenon, argon, krypton or a mixture thereof, and a light-emitting material such as mercury is sealed in as necessary. The pressure of the filler gas at the time of filling is, for example, 0.1 to 10 atm. If mercury is used as a light-emitting material, the amount used relative to the volume of the light-emitting tube 11 of the bulb 10 is from 0.5 to 60 mg/cc.

Figure 5A:
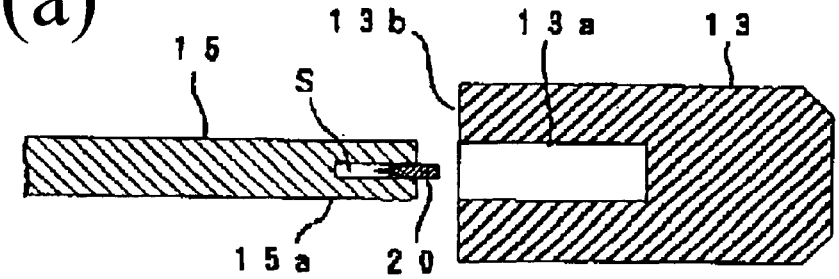
FIGS. 5(*a*)–5(*c*) are cross-sectional views showing steps in the process of fixing the anode on the tip of the electrode support bar in accordance with the invention.
Figure 5B:
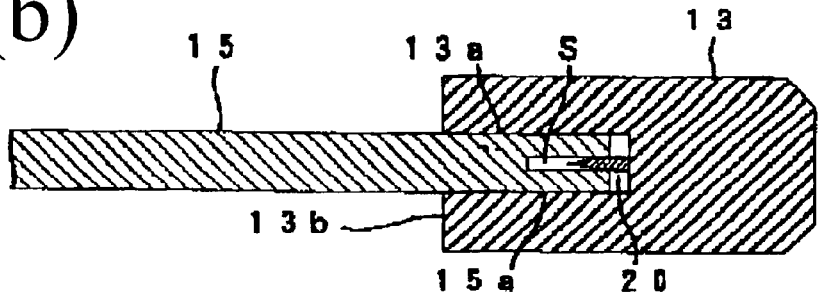
Figure 5C:
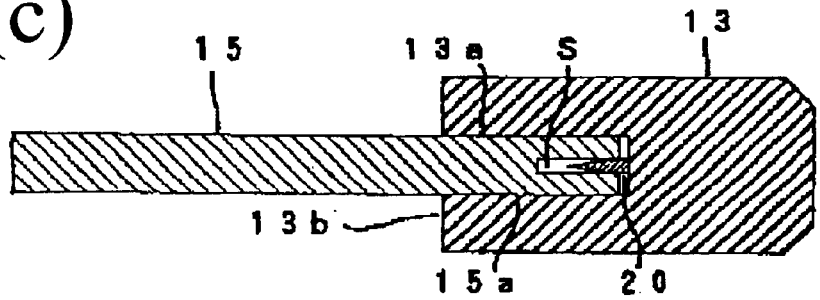

In a discharge lamp with the constitution described above, the electrode is fixed to the tip of the electrode support bar in the following way. First, as shown in FIG. 5(*a*), the spreader piece 20 is mounted in the slit S formed in the tip 15*a* of the electrode support bar 15. Next, as shown in FIG. 5(*b*), the tip 15*a* of the electrode support bar 15 in which the spreader piece 20 is mounted is inserted into the concavity 13*a* formed in the base surface 13*b* of the anode 13. Then, the tip 15*a* of the electrode support bar 15 is pushed into the concavity 13*a* of the anode 13, and the spreader piece 20 is pushed, by the bottom of the concavity 13*a* of the anode 13, further into the slit S of the electrode support bar 15 as shown in FIG. 5(*c*). As a result, the slit S is spread, the outer surface of the electrode support bar 15 is pressed against the inner surface of the concavity 13*a* of the anode 13, and the anode 13 is fixed to the tip 15*a* of the electrode support bar 15. The cathode 14 is fixed to the tip of its electrode support bar 15 in the same way as the anode 13.

As stated above, with the discharge lamp of this invention, it is possible to fit the tip 15*a* of the electrode support bar 15 to the concavity 13*a* formed in the base surface 13*b* of the anode 13 without using buffer material, and consequently, there is no need for processes to adjust the thickness of the buffer material, or to trim the excess buffer material. Moreover, there is no need to taper the concavity 13*a* of the anode 13 or the tip 15*a* of the electrode support bar 15, and so it is possible to fit the tip 15*a* of the electrode support bar 15 into the anode 13 easily, with simple processes. In addition, the slit formed in the tip 15*a* of the electrode support bar 15 is spread by the spreader piece 20 and the outer surface of the electrode support bar 15 is pressed against the inner surface of the concavity 13*a* to the anode 13, and so the anode 13 can be fixed to the tip 15*a* of the electrode support bar 15 stably, with no fluctuation of holding power from product to product, and with great holding power. Still further, because the electrode support bar 15 is made of molybdenum with great plasticity and toughness, it is possible to prevent damage to the tip 15*a* of the electrode support bar 15 when the spreader piece 20 is pushed into the slit S and spreads the slit S.

The discharge lamp of this invention is not limited to the mode of implementation described above; it is possible to make a variety of changes.

Figure 6:
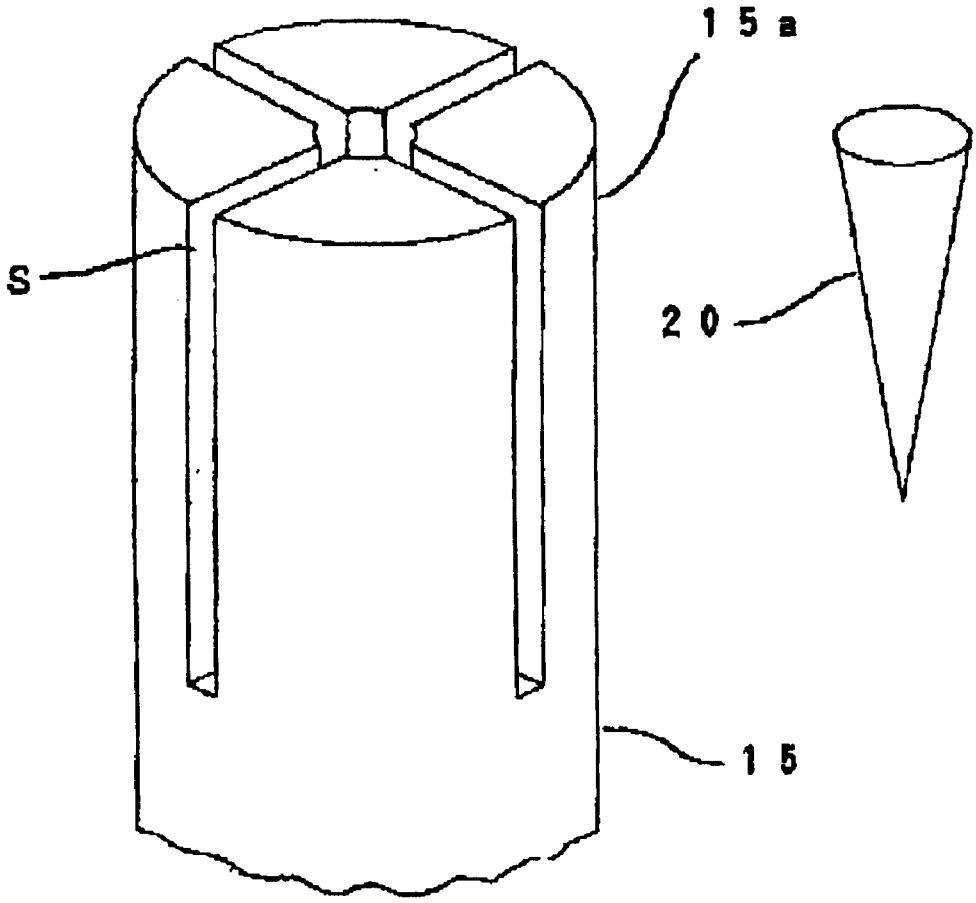
FIG. 6 is an explanatory perspective view showing the tip of the electrode support bar and the spreader piece of another embodiment of this invention.

(1) As shown in FIG. 6, the slit S formed in the tip 15*a* of the electrode support bar 15 can be in the form of two perpendicular diametrical cuts to make a cross-shape, with the four corners where the cuts intersect being arcuately cut so that four arcs are formed which together create a cylindric holder that allows a conical pin to be used as the spreader piece 20.

(2) The specific shape of the bulb 10 (light-emitting tube 11 and seal tubes 12) is not limited to the structure shown in FIG. 1; a variety of structures may be used.

Test Case

Following the structure shown in FIG. 2, a total of 10 sets of anodes (13), electrode support bars (15) and spreader pieces (20) were assembled under the following conditions.

{Anode (13)}

Material: tungsten

Diameter: 25 mm

Diameter of concavity (13*a*): 6.2 mm

Depth of concavity 13*a*: 20 mm

{Electrode support bar (15)}

Material: molybdenum

Diameter of tip (15*a*): 6.0 mm

Width of slit (S): 0.5 mm

Depth of slit (S): 10 mm

{Spreader piece (20)}

Material: molybdenum

Length: 5 mm

Thickness of base: 1.0 mm

Width: 5 mm

Using the anode 13, electrode support bar 15 and spreader piece 20 described above and following the process in FIGS. 5*a* to 5*c*, the tip 15*a* of the electrode support bar 15 was fitted to concavity 13*a* of the anode 13 and thus the anode 13 was fixed to the tip 15*a* of the electrode support bar 15. In doing this, the force with which the tip 15*a* of the electrode support bar 15 was pushed into the concavity 13*a* of the anode 13 was about 1 ton. Then, the holding power of the anode 13 for the electrode support bar 15 (the force necessary to remove the tip 15*a* of the electrode support bar 15 from the concavity 13*a* of the anode 13 was measured. In all cases, the holding power was in the range from 189 to 205 kg; it was confirmed that the anode 13 was stably fixed to the tip 15*a* of the electrode support bar 15 with a great holding power.

Control Case

Figure 7A:
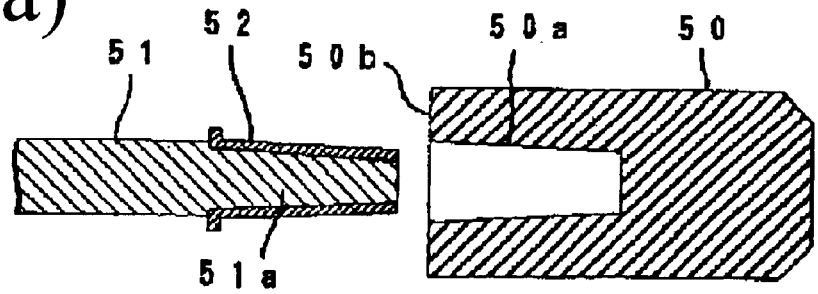
FIG. 7(a) (Prior Art)
FIGS. 7(*a*)–7(*c*) are cross-sectional views showing the process of fixing an electrode on the tip of the electrode support bar of a conventional short arc discharge lamp.
Figure 7B:
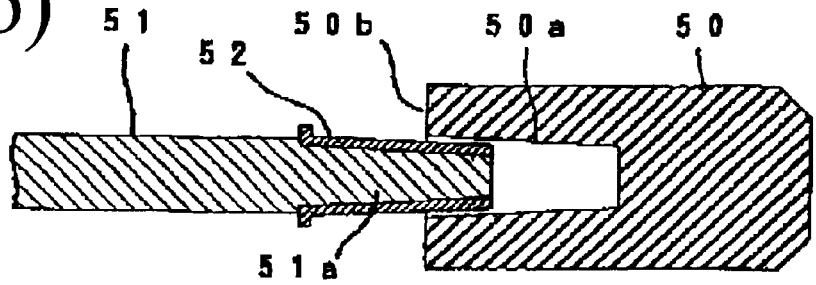
FIG. 7(b) (Prior Art)
Figure 7C:
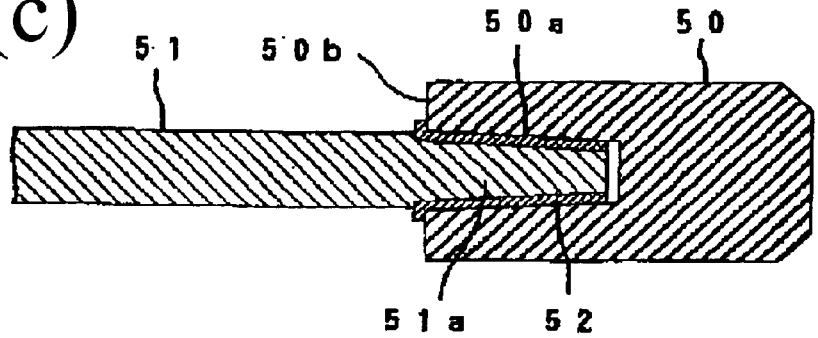
FIG. 7(c) (Prior Art)

Following the structure shown in FIG. 7(*a*), a total of 10 sets of electrodes 50 and electrode support bars 51 were assembled under the following conditions.

{Electrode (50)}

Material: tungsten

Diameter: 25 mm

Diameter of concavity (13*a*): 5.8 mm (0.06/20 mm taper)

{Electrode support bar (51)}

Material: tungsten

Diameter of tip (15*a*): 6.65 mm (0.06/20 mm taper)

Using the electrode 50 and electrode support bar 51 described above and following the process in FIGS. 7(*a*) to 7(*c*), the tip 51*a* of the electrode support bar 51 was fitted into the concavity 50*a* of the electrode 50, and thus, the electrode 50 was fixed to the tip 51*a* of the electrode support bar 51. In doing this, molybdenum foil 0.05 mm thick was used as the buffer material 52. The force with which the tip 51*a* of the electrode support bar 51 was pushed into the concavity 50*a* of the electrode 50 was about 1 ton. Then, the holding power of the electrode 50 for the electrode support bar 51 (the force necessary to remove the tip 51*a* of the electrode support bar 51 from the concavity 50*a* of the electrode 50) was measured. The holding power was in the range from 40 to 250 kg; and fluctuated considerably from one product to the next.

EFFECT OF INVENTION

With the discharge lamp of the invention, it is possible to fit the tip of the electrode support bar in to a concavity formed in the base of the electrode, without using buffer material. Thus there is no need for the operation to adjust the thickness of the buffer material or the operation to trim away the excess buffer material, and there is no need to taper the concavity of the electrode or the tip of the electrode support bar. And so, the tip of the electrode support bar can be fitted easily to the concavity in the electrode by a simple process. Moreover, because a slit in the tip of the electrode support bar is spread and the outer surface of the electrode support bar is pressed against the inner surface of the electrode, the electrode is fixed to the tip of the electrode support bar stably, with no fluctuation from one product to the next, and with great holding power.

When the electrode support bar is formed of molybdenum, which has high plasticity and toughness, it is possible to prevent damage to the tip of the electrode support bar when the slit is spread.

What is claimed is:

1. A discharge lamp comprising an electrode support bar and an electrode supported by a tip of the electrode support bar being engaged in a concavity in an end of the electrode; wherein the tip of the electrode support bar has at least one slit into which a spreader piece is inserted spreading the slit causing the tip of the electrode support bar to firmly engage against an inner surface of said concavity.

2. A discharge lamp as described in claim 1, wherein the electrode support bar is made of molybdenum.

3. A discharge lamp as described in claim 1, wherein the spreader piece projects from an end of said electrode support bar and engages a facing end surface of the concavity in the end of the electrode.

4. A discharge lamp as described in claim 1, wherein the at least one slit is an intersecting arrangement of slits, corners at an intersection of the slits being concavely arcuately shaped; and wherein the spreader piece is conical and inserted at said intersection.

5. A discharge lamp as described in claim 1, wherein a width of the slit of the electrode support bar is 3 to 10% of an exterior diameter of the tip of the electrode support bar.

6. A discharge lamp as described in claim 1, wherein a maximum thickness of the spreader piece is 1.5 to 2.5 times a width of the slit of the electrode support bar.

* * * * *